US010421576B2

(12) United States Patent
Couture

(10) Patent No.: US 10,421,576 B2
(45) **Date of Patent: *Sep. 24, 2019**

(54) CARTON, BLANK, AND METHOD OF FOLDING

(71) Applicant: WestRock Shared Services, LLC, Atlanta, GA (US)

(72) Inventor: David G. Couture, Hoschton, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/136,455

(22) Filed: Sep. 20, 2018

(65) Prior Publication Data

US 2019/0016498 A1 Jan. 17, 2019

Related U.S. Application Data

(62) Division of application No. 14/968,326, filed on Dec. 14, 2015, now Pat. No. 10,106,290.

(51) Int. Cl.
*B65D 5/00* (2006.01)
*B65D 5/20* (2006.01)
(Continued)

(52) U.S. Cl.
CPC ..... *B65D 5/003* (2013.01); *B31B 50/20* (2017.08); *B31B 50/60* (2017.08); *B65D 5/20* (2013.01);
(Continued)

(58) Field of Classification Search
CPC ..... B65D 5/003; B65D 5/20; B65D 5/4608; B65D 5/563; B31B 50/60
(Continued)

(56) References Cited

U.S. PATENT DOCUMENTS 2,373,730 A 4/1945 Pantalone
3,114,493 A * 12/1963 Dunkin ..... B65D 5/0035 206/511
(Continued)

FOREIGN PATENT DOCUMENTS

GB 1233719 A 5/1971
WO WO2014183067 11/2015

OTHER PUBLICATIONS

"International Fibreboard Case Code," FEFCO (European Federation of Corrugated Board Manufacturers, 11th Edition (2007). For example, Design 0424.
(Continued)

*Primary Examiner* — Christopher R Demeree
(74) *Attorney, Agent, or Firm* — WestRock IP Legal

(57) ABSTRACT

A carton defines a bottom wall, a first side wall coupled to the bottom wall, a second side wall disposed opposite the first side wall and coupled to the bottom wall, a first end wall coupled to both the bottom wall and first and second side walls, and a second end wall disposed opposite the first end wall and coupled to both the bottom wall and the first and second side walls. The carton is formed from a blank having a first side and a second side disposed opposite said first side. The first side defines the interior surface of the bottom wall and the interior and exterior surfaces of the first and second side walls and the first and second end walls.

13 Claims, 9 Drawing Sheets

(51) Int. Cl.

| | |
|---|---|
| ***B65D 5/468*** | (2006.01) |
| ***B65D 5/56*** | (2006.01) |
| ***B31B 50/60*** | (2017.01) |
| ***B31B 50/20*** | (2017.01) |
| *B31B 50/26* | (2017.01) |
| *B31B 100/00* | (2017.01) |
| *B31B 50/73* | (2017.01) |
| *B31B 110/35* | (2017.01) |

(52) U.S. Cl.
CPC ..... *B65D 5/4608* (2013.01); *B65D 5/563* (2013.01); *B31B 50/26* (2017.08); *B31B 50/732* (2017.08); *B31B 2100/00* (2017.08); *B31B 2110/35* (2017.08)

(58) Field of Classification Search
USPC ..... 229/122.32, 117.02, 174, 178, 919, 915, 229/117.12
See application file for complete search history.

(56) References Cited

U.S. PATENT DOCUMENTS

| | | | | | |
|---|---|---|---|---|---|
| 3,913,823 | A | | 10/1975 | Lin | |
| 4,148,429 | A | | 4/1979 | Burr et al. | |
| 4,291,826 | A | | 9/1981 | Swanson | |
| 4,335,843 | A | | 6/1982 | Kent | |
| 4,911,355 | A | * | 3/1990 | Bannister | B65D 5/0045 229/143 |
| 5,302,323 | A | | 4/1994 | Hartung et al. | |
| 5,328,090 | A | | 7/1994 | Hanlon | |
| 5,535,942 | A | * | 7/1996 | Vilona | B65D 5/0035 229/122.32 |
| 5,853,120 | A | | 12/1998 | McLeod et al. | |
| 5,979,746 | A | | 11/1999 | McLeod et al. | |
| 6,131,805 | A | * | 10/2000 | Gasior | B65D 5/0025 229/174 |
| 6,302,323 | B1 | * | 10/2001 | Southwell | B65D 5/0035 229/164 |
| 6,502,698 | B1 | * | 1/2003 | McKenna | B65D 5/0015 206/509 |
| 6,508,395 | B2 | | 1/2003 | McLeod et al. | |
| 6,581,772 | B2 | * | 6/2003 | Noland | B65D 5/0025 206/509 |
| 6,641,032 | B1 | * | 11/2003 | Schilling | B65D 5/0025 206/509 |
| 7,207,473 | B2 | * | 4/2007 | Fry | B65D 5/0015 229/174 |
| 7,365,080 | B2 | | 4/2008 | Gregor et al. | |
| 7,635,080 | B2 | * | 12/2009 | Conway | B65D 5/0025 229/169 |
| 7,681,785 | B2 | * | 3/2010 | Grigor | B65D 5/0015 229/174 |
| 8,191,761 | B2 | | 6/2012 | Brand | |
| 8,205,787 | B2 | * | 6/2012 | Panduro, Jr. | B65D 5/0015 229/143 |
| 9,469,432 | B2 | * | 10/2016 | Aguirre | B65D 5/443 |
| 2002/0008134 | A1 | | 1/2002 | Southwell | |
| 2003/0111523 | A1 | | 6/2003 | Haugan | |
| 2005/0017063 | A1 | * | 1/2005 | Noone | B65D 5/0015 229/176 |
| 2009/0272789 | A1 | | 11/2009 | Fry | |
| 2011/0272455 | A1 | | 11/2011 | Robinson et al. | |
| 2014/0141951 | A1 | | 5/2014 | Aganovic et al. | |
| 2014/0141952 | A1 | | 5/2014 | Graham et al. | |
| 2014/0249008 | A1 | | 9/2014 | Aganovic et al. | |
| 2015/0336706 | A1 | | 11/2015 | Smith et al. | |

OTHER PUBLICATIONS

"VPS Box Designs", Smurfit-Stone Corrugated Container Division, Westmont, Illinois. Exact date unknown; some pages dated 2004.

* cited by examiner

CARTON, BLANK, AND METHOD OF FOLDING

REFERENCE TO RELATED APPLICATION

This application is a Divisional of U.S. application Ser. No. 14/968326 filed on Dec. 14, 2015, which is hereby incorporated by reference in its entirety.

TECHNICAL FIELD

The present invention relates to a carton, to a blank and method for forming the carton, and more particularly to a carton formed from a blank having a first side and a second side, the first side defining the interior surface of the carton's bottom wall and the interior and exterior surfaces of the carton's side and end walls.

BACKGROUND

Reusable plastic crates (RPCs) are widely-used in the grocery industry for transporting, storing, and distributing foods such as fresh fruits and vegetables. Advantages of RPCs include a stackable interlocking design, a "display ready" design that can significantly reduce stocking time, and a foldable design that reduces storage space and transport costs by allowing the containers to be folded when not in use. Disadvantages of RPCs include the risk of loss/theft and a relatively high cost resulting from the need to wash and sanitize the RPCs after each use and transport them to a facility for that purpose.

More recently, single-use, corrugated alternatives to RPCs have been used. FIG. 4A shows a blank 90 for forming a carton 300 according to the prior art. The blank 90 includes a treated side and an untreated side. The treated side can be printed with, e.g., informational or promotional information such as a brand name or logo and/or treated with one or more coatings such as, e.g., one or more waterproof coatings. Outer side panels 114, 118 are folded up about bottom panel 116 to form the outer side walls of the carton 300. Inner side panels 112, 120 are folded down into the interior of the carton 300 to form the carton's inner side walls. Inner end flaps 122, 124, 138, 140 are folded to form the inner end walls of the carton 300. Outer end flaps 126, 128, 134, 136 are sandwiched between inner end flaps and end panels 130, 132 which fold up to form the carton's outer end walls. Side tabs F11 and F12 fold down into the interior of the carton to form stacking tabs that project from an upper edge of the carton's side walls. Cutouts C15 in inner and outer end flaps align with one another and with cutouts C17 to form handles that extend completely through the carton's end walls. There are several drawbacks to the approach taken with carton 300. First, the carton 300 does not provide a smooth or visually clean interior as a result of the inwardly-folded stacking tabs and inner end flaps. The irregularities in the interior surface of the carton 300 caused by these structures may also increase the risk of damage to the carton's contents. These irregularities may also interfere with the visibility and/or clarity of any content printed on the interior side and end walls. The arrangement of carton 300 also results in the carton's interior bottom surface being formed from the untreated side of the blank. This configuration may be considered aesthetically unappealing and/or represent a missed opportunity to present branding or other promotional content to customers. Finally, the configuration of the handles, which extend completely through the carton's end walls, may increase the risk of "finger poke" damage to the carton's contents. The present invention seeks to overcomer or at least mitigate the problems of the prior art.

SUMMARY

According to a first aspect of the invention, there is provided a carton for containing a plurality of articles. The carton includes a bottom wall, a first side wall coupled to the bottom wall, a second side wall disposed opposite the first side wall and coupled to the bottom wall, a first end wall coupled to both the bottom wall and the first and second side walls, and a second end wall disposed opposite the first end wall and coupled to both the bottom wall and the first and second side walls. Each of the bottom wall, the first and second side walls, and the first and second end walls define both an interior surface disposed adjacent an interior space defined by the carton and an exterior surface. The carton is formed from a blank including a first side and a second side disposed on a side of the blank opposed to the first side. The interior surface of the bottom wall, and the interior and exterior surfaces of the first and second side walls are each defined by the first side.

Optionally, the first side is a treated side and the second side is an untreated side, the treated side having received one or more surface treatments, and the untreated side not having received the one or more surface treatments.

Optionally, the one or more surface treatments includes printing.

Optionally, the one or more surface treatments includes application of a water-resistant coating.

Optionally, the inter surfaces of the first and second end walls are each substantially smooth and uninterrupted by folded edges.

Optionally, the interior surfaces of the first and second side walls and the interior surface of the bottom are each substantially smooth and uninterrupted by folded edges.

Optionally, the blank includes a plurality of main panels hinged together in a linear series, the plurality of main panels including first and second inner side panels, first and second outer side panels, and a bottom panel. The first outer side panel is hingedly connected to the first inner side panel, the first inner side panel is hingedly connected to the bottom panel, the bottom panel is hingedly connected to the second inner side panel, and the second inner side panel is hingedly connected to the second outer side panel. The first outer side panel defines the exterior surface of the first side wall. The first inner side panel defines the interior surface of the first side wall. The bottom panel defines the exterior and interior surfaces of the bottom wall. The second inner side panel defines the interior surface of the second side wall, and the second outer side panel defines the exterior surface of the second side wall.

Optionally, the blank also includes first and second end panels hingedly connected to the bottom panel at respective opposite ends of the bottom panel. The first end panel defines the interior surface of the first end wall, and the second end panel defines the interior surface of the second end wall.

Optionally, the blank also includes first and second outer end flaps hingedly connected to the first outer side panel at respective opposite ends of the first outer side panel, and third and fourth outer end flaps hingedly connected to the second outer side panel at respective opposite ends of the second outer side panel. The first and third outer end flaps define the exterior surface of the first end wall and the second and fourth outer end flaps define the exterior surface of the second end wall.

Optionally, the blank further includes first and second inner end flaps hingedly connected to the first inner side panel at respective opposite ends of the first inner side panel, and third and fourth inner end flaps hingedly connected to the second inner side panel at respective opposite ends of the second inner side panel.

Optionally, the blank defines a plurality of inner end flap apertures, each of the plurality of inner end flap apertures being disposed along a central length of a fold line disposed between one of the first, second, third, or fourth inner end flaps and a respective one of the first or second inner side panels.

Optionally, the first and second end walls define respective first and second handle structures.

Optionally, the first handle structure includes a first handle aperture disposed on the exterior surface of the first end wall, wherein the first handle aperture does not extend completely through the first end wall. The second handle aperture includes a second handle aperture disposed on the exterior surface of the second end wall, wherein the second handle aperture does not extend completely through the second end wall.

Optionally, the first side wall defines at least one first stacking tab that projects from an upper edge of the first side wall. The second side wall defines at least one second stacking tab that projects from an upper edge of the second side wall.

Optionally, the at least one first stacking tab includes a first folding tab that projects from an upper edge of the interior surface of the first side wall and is folded back onto the exterior surface of the first side wall. The at least one second stacking tab includes a second folding tab that projects from an upper edge of the interior surface of the second side wall and is folded back onto the exterior surface of the second side wall.

Optionally, the carton defines at least one first side aperture and at least one second side aperture, the at least one first side aperture defined in part by both the bottom wall and the first side wall, and the at least one second side aperture being defined in part by both the bottom wall and the second side wall. Each of the at least one first side aperture and the at least one second side aperture is configured to receive a stacking tab of a second carton.

Optionally, the carton defines at least one first end aperture and at least one second end aperture, the at least one first end aperture being defined in part by both the bottom wall and the first end wall, the at least one second end aperture being defined in part by both the bottom wall and the second end wall.

According to a second aspect of the invention, there is provided a blank for forming a carton. The blank includes a first side and a second side disposed on a side of the blank opposed to the first side. The blank includes a plurality of panels and flaps, the plurality of panels and flaps configured to form a set-up carton defining a bottom wall, a first side wall coupled to the bottom wall, a second side wall disposed opposite the first side wall and coupled to the bottom wall, a first end wall coupled to both the bottom wall and the first and second side walls, and a second end wall disposed opposite the first end wall and coupled to both the bottom wall and the first and second side walls. Each of the bottom wall, the first and second side walls, and the first and second end walls define both an interior surface disposed adjacent an interior space defined by the set-up carton and an exterior surface. The interior surface of the bottom wall and the interior and exterior surfaces of the first and second side walls and first and second end walls are each defined by the first side of the blank.

Optionally, the first side is a treated side and the second side is an untreated side, the treated side having received one or more surface treatments, and the untreated side not having received the one or more surface treatments.

Optionally, the one or more surface treatments includes printing.

Optionally, the one or more surface treatments includes application of a water-resistant coating.

Optionally, the plurality of panels and flaps includes a plurality of main panels hinged together in a linear series. The plurality of main panels include first and second inner side panels, first and second outer side panels, and a bottom panel. The first outer side panel is hingedly connected to the first inner side panel. The first inner side panel is hingedly connected to the bottom panel. The bottom panel is hingedly connected to the second inner side panel. The second inner side panel is hingedly connected to the second outer side panel. The first outer side panel defines the exterior surface of the first side wall. The first inner side panel defines the interior surface of the first side wall. The bottom panel defines the exterior and interior surfaces of the bottom wall. The second inner side panel defines the interior surface of the second side wall. The second outer side panel defines the exterior surface of the second side wall.

Optionally, the blank further includes first and second end panels hingedly connected to the bottom panel at respective opposite ends of the bottom panel, wherein the first end panel defines the interior surface of said first end wall and wherein the second end panel defines the interior surface of the second end wall.

Optionally, the blank further includes first and second outer end flaps hingedly connected to the first outer side panel at respective opposite ends of the first outer side panel and third and fourth outer end flaps hingedly connected to the second outer side panel at respective opposite ends of the second outer side panel. The first and third outer end flaps define the exterior surface of the first end wall and the second and fourth outer end flaps define the exterior surface of the second end wall.

Optionally, the blank further includes first and second inner end flaps hingedly connected to the first inner side panel at respective opposite ends of the first inner side panel, and third and fourth inner end flaps hingedly connected to the second inner side panel at respective opposite ends of the second inner side panel.

According to a third aspect of the invention, there is provided a method of forming a carton. The method includes providing a blank having a first blank side and a second blank side disposed opposite the first blank side. The blank includes a plurality of main panels hinged together in a linear series. The plurality of main of main panels includes a bottom panel, first and second inner side panels, and first and second outer side panels. The first outer side panel is hingedly connected to the first inner side panel. The first inner side panel is hingedly connected to the bottom panel. The bottom panel is hingedly connected to the second inner side panel. The second inner side panel is hingedly connected to the second outer side panel. The blank further includes first and second end panels, first, second, third, and fourth inner end flaps, and first, second, third, and fourth outer end flaps. The first and second end panels are hingedly connected to the bottom panel at respective opposite ends of the bottom panel. The first and second outer end flaps are hingedly connected to the first outer side panel at respective opposite ends of the first outer side panel. The third and fourth outer end flaps are hingedly connected to the second outer side panel at respective opposite ends of the second outer side panel. The first and second inner end flaps are hingedly connected to the first inner side panel at respective opposite ends of the first inner side panel. The third and fourth inner end flaps are hingedly connected to the second inner side panel at respective opposite ends of the second inner side panel. The method also includes folding the first outer side panel back onto the first inner side panel and securing it thereto such that second blank side surfaces of the first outer side panel and the first inner side panel are coupled together in a face-contacting relationship. The method also includes folding the second outer side panel back onto the first inner side panel and securing it thereto such that second blank side surfaces of the second outer side panel and the second inner side panel are coupled together in a face-contacting relationship. The method further includes folding the first outer side panel and the first inner side panel about said bottom panel so as to form a first side wall of the carton. An exterior surface of the first side wall is defined by a first blank side surface of the first outer side panel. An interior surface of the first side wall is defined by a first blank side surface of the first inner side panel. A first blank side surface of the bottom panel defines an interior surface of a bottom wall of the carton. The method further includes folding the second outer side panel and the second inner side panel about the bottom panel so as to form a second side wall of the carton. An exterior surface of the second side wall is defined by a first blank side surface of the second outer side panel. An interior surface of the second side wall is defined by a first blank side surface of the second inner side panel. The method further includes folding the first and second end panels about the bottom panel to form respective first and second end walls of the carton. A first blank side surface of the first end panel defines an interior surface of the first end wall. A first blank side surface of the second end panel defines an interior surface of the second end wall. The method further includes folding the first and third inner end flaps and the first and third outer end flaps into an overlapping arrangement with a second blank side of the first end panel and securing them thereto, a first blank side surface of the first and third outer end flaps defining an exterior surface of said first end wall. The method further includes folding the second and fourth inner end flaps and the second and fourth outer end flaps into an overlapping arrangement with a second blank side of the second end panel and securing them thereto, a first blank side surface of the second and fourth outer end flaps defining an exterior surface of the second end wall.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the term "carton" refers, for the non-limiting purpose of illustrating the various features of the invention, to a container for transporting, storing, and/or dispensing articles, such as, e.g., fresh produce. However, it is contemplated that the teachings of the invention can be applied to various containers suitable for carrying a wide variety of articles.

Figure 1:
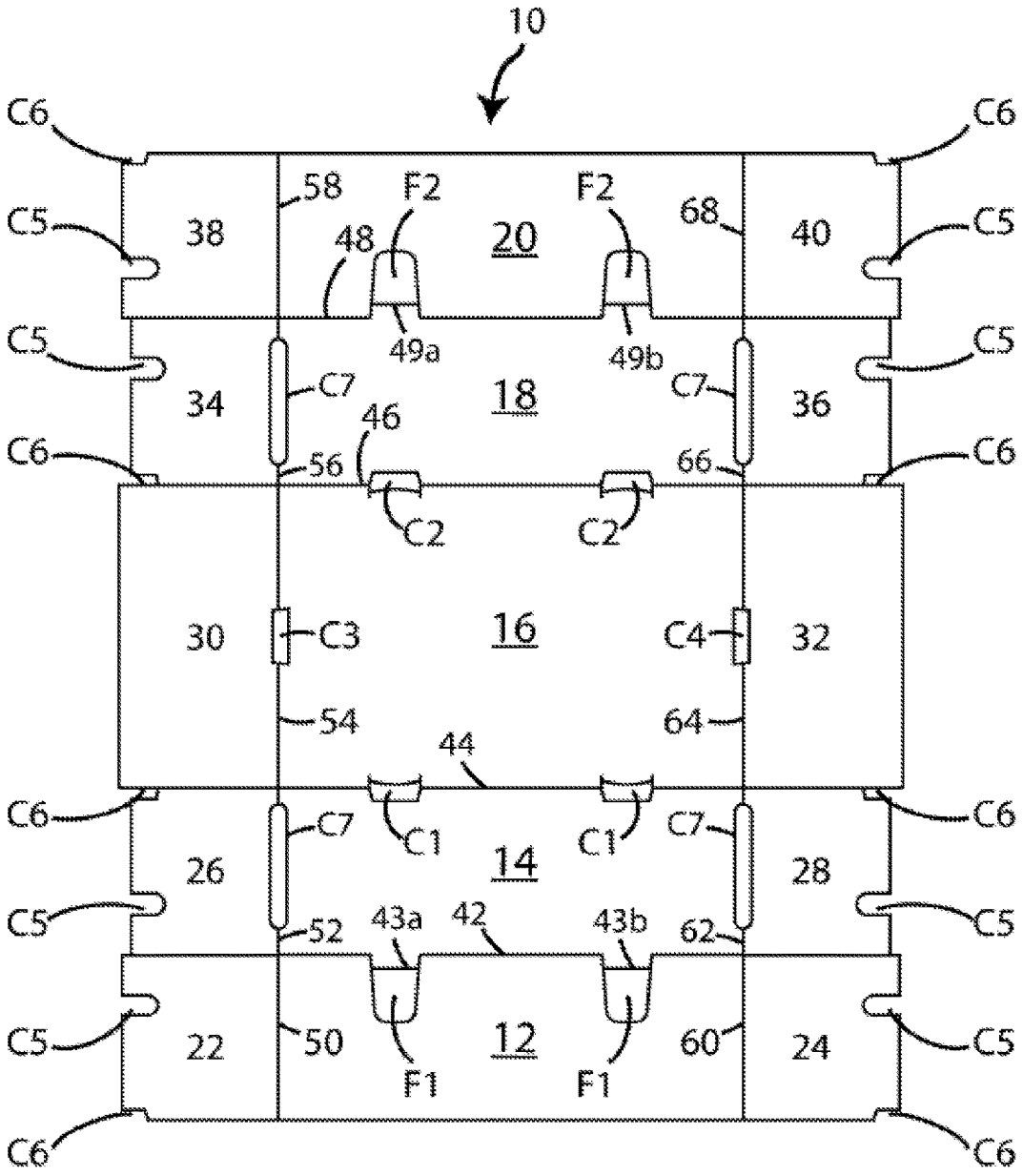
FIG. 1 is a plan view of a blank for forming a carton according to an embodiment of the invention.
Figure 2:
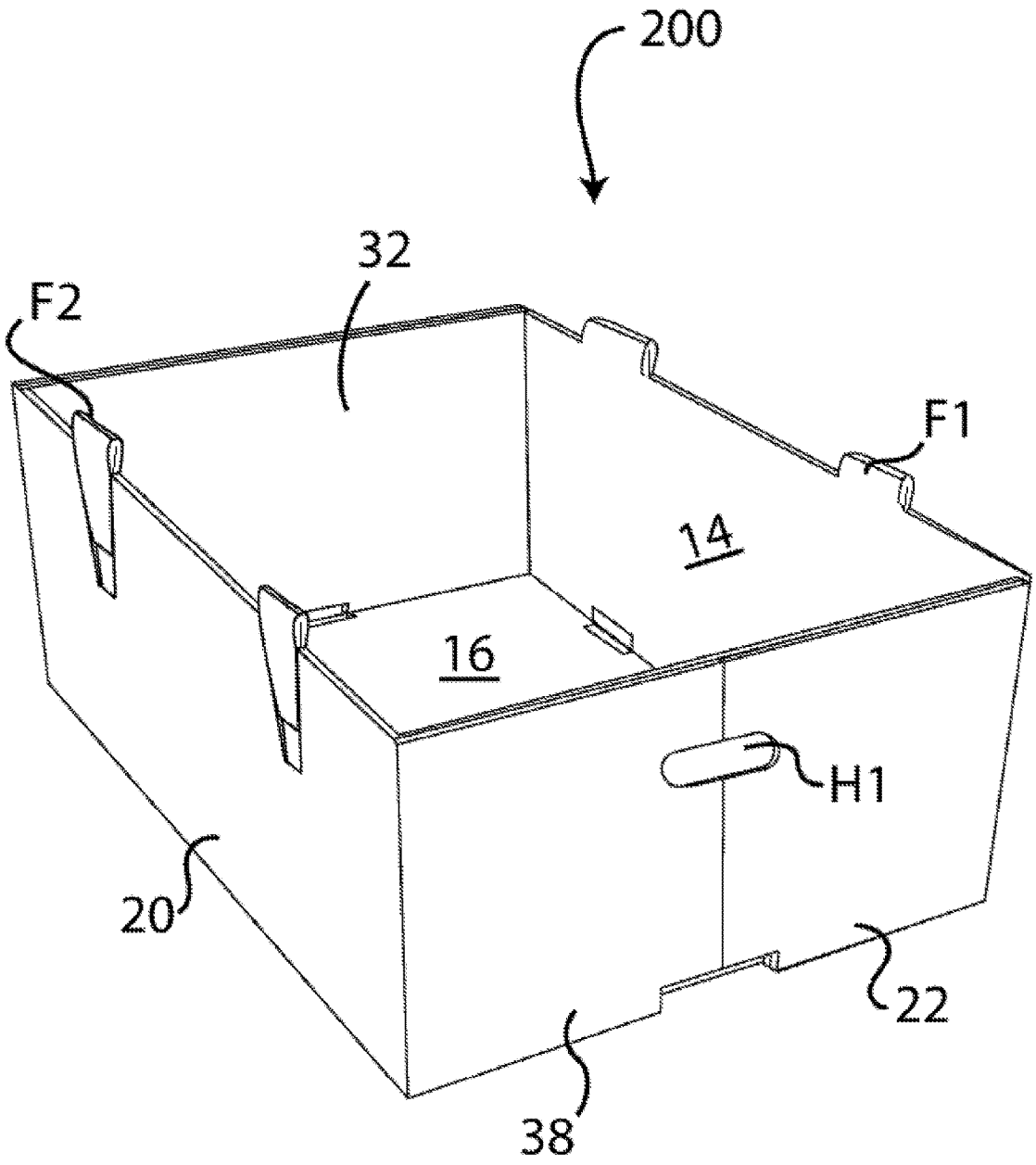
FIG. 2 is a perspective view of a carton formed from the blank of FIG. 1.

Referring to FIG. 1, there is shown a first blank 10 for forming a carton 200 (see FIG. 2). The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the carton described in more detail below.

In a preferred embodiment, blank 10 is formed from a paperboard, corrugated board, or cardboard in which one side of the blank, referred to herein as the "treated side," is printed and/or treated with one or more coatings, such as for example, one or more waterproof coatings and/or one or more coatings designed to provide a smooth and/or visually-attractive surface (e.g., a white or other colored surface). In one or more embodiments, informational or promotional material such as, e.g., a brand name or logo, can be printed on the treated side.

Referring to FIG. 1, blank 10 is generally rectangular in shape and includes a plurality of main panels 12, 14, 16, 18, 20 hinged together in a linear series. End panels 30, 32 and end flaps 22, 24, 26, 28, 34, 36, 38, 40 are hingedly connected at respective ends of a corresponding one of the main panels. In a set-up condition, the carton 200 forms an open-topped structure having a base or bottom wall, first and second side walls, and first and second end walls.

The blank 10 includes a first outer side panel 12 hinged to a first inner side panel 14 by a fold line 42. The first inner side panel 14 is hinged to a bottom panel 16 by a fold line 44. Bottom panel 16 is hinged to a second inner side panel 18 by a fold line 46. Second inner side panel 18 is hinged to a second outer side panel 20 by a fold line 48.

First outer side panel 12 is also hinged at a first end to first outer end flap 22 via fold line 50. First outer side panel 12 is hinged at a second end to second outer end flap 24 via fold line 60.

First inner side panel 14 is also hinged at a first end to first inner end flap 26 via fold line 52. First inner side panel 14 is hinged at a second end to second inner end flap 28 via fold line 62.

Bottom panel 16 is also hinged at a first end to first end panel 30 via fold line 54. Bottom panel 16 is hinged at a second end to second end panel 32 via fold line 64.

Second inner side panel 18 is also hinged at a first end to a third inner end flap 34 via fold line 56. Second inner side panel 18 is hinged at a second end to a fourth inner end flap 36 via fold line 66.

Second outer side panel 20 is also hinged at a first end to a third outer end flap 38 via fold line 58. Second outer side panel 20 is hinged at a second end to a fourth outer end flap 40 via fold line 68.

In the illustrated embodiment, the various end flaps/end panels are defined by, and separated from adjoining end flaps/panels by, severance lines that extend from opposite ends of a corresponding one of fold lines 42, 44, 46, 48.

First inner side panel 14 includes a plurality of first side tabs F1. First side tabs F1 interrupt fold line 42. Each of first side tabs F1 is defined by a generally U-shaped severance line that extends from fold line 42 into an interior of first outer side panel 12. In the illustrated embodiment, blank 10 includes two first side tabs F1. First side tabs F1 are generally trapezoidal in shape. First side tabs F1 are hingedly connected to a remaining portion of first inner side panel 14 via respective fold lines 43*a*, 43*b*. Fold lines 43*a*, 43*b* are generally parallel to fold line 42 but offset from fold line 42 in the direction of first outer side panel 12.

Similarly, second inner side panel 18 includes a plurality of second side tabs F2 that may generally mirror first side tabs F1. Second side tabs F2 interrupt fold line 48. Each of second side tabs F2 is defined by a generally U-shaped severance line that extends from fold line 48 into an interior of second outer side panel 20. In the illustrated embodiment, blank 10 includes two second side tabs F2. Second side tabs are generally trapezoidal in shape. Second side tabs F2 are hingedly connected to a remaining portion of second inner side panel 18 via respective fold lines 49*a*, 49*b*. Fold lines 49*a*, 49*b* are generally parallel to fold line 48 but offset from fold line 48 in the direction of second outer side panel 20.

Blank 10 includes a plurality of first side apertures C1. In the illustrated embodiment, blank 10 includes two first side apertures C1. Each of the first side apertures C1 is generally rectangular or trapezoidal in shape. Each of the first side apertures C1 interrupts fold line 44 and is disposed such that the aperture extends into both the bottom panel 16 and first inner side panel 14. Each of the first side apertures C1 is aligned with a corresponding one of the first side tabs F1 relative to a longitudinal axis of the blank 10.

Similarly, blank 10 includes a plurality of second side apertures C2 that may generally mirror first side apertures C1. In the illustrated embodiment, blank 10 includes two second side apertures C2. Each of the second side apertures C2 is generally rectangular or trapezoidal in shape. Each of the second side apertures C2 interrupts fold line 46 and is disposed such that the aperture extends into both the bottom panel 16 and second inner side panel 18. Each of the second side apertures C2 is aligned with a corresponding one of the second side tabs F2 relative to a longitudinal axis of the blank 10.

Blank 10 also includes at least one first end aperture C3. First end aperture C3 is generally rectangular or trapezoidal in shape. First end aperture C3 interrupts fold line 54 and is disposed such that the aperture extends into both the bottom panel 16 and first end panel 30.

Blank 10 also includes at least one second end aperture C4 that may generally mirror first end aperture C3. Second end aperture C4 is generally rectangular or trapezoidal in shape. Second end aperture C4 interrupts fold line 64 and is disposed such that the aperture extends into both the bottom panel 16 and second end panel 32.

End flaps 22, 24, 26, 28, 34, 36, 38, 40 each include a generally U-shaped cutout C5 disposed on an outer edge of the flap. Cutouts C5 of the first, second, third, and fourth outer end flaps 22, 24, 38, 40 are configured to align with and overlap respective cutouts C5 of the first, second, third, and fourth inner end flaps 26, 28, 34, 36 when the carton is in the setup condition.

End flaps 22, 24, 26, 28, 34, 36, 38, 40 each include a generally rectangular-shaped cutout C6 disposed on an outer corner edge of the flap. Cutouts C6 of the first, second, third, and fourth outer end flaps 22, 24, 38, 40 are configured to align with and overlap respective cutouts C6 of the first, second, third, and fourth inner end flaps 26, 28, 34, 36 when the carton is in the setup condition. In addition, the various cutouts C6 are configured to align with and overlap a corresponding portion of either the first or second end apertures C3, C4 when the carton is in the setup condition.

Blank 10 also includes four inner end flap apertures C7. Each of the inner end flap apertures C7 has a generally elongated rectangular shape. The inner end flap apertures C7 are disposed along a central length of, and interrupt, their respective fold lines 52, 62, 56, 66 such that the apertures extend into both their respective inner end flaps 26, 28, 34, 36 and a respective one of first and second inner side panels 14, 18. Inner end flap apertures C7 may facilitate the overlapping folding arrangement of inner and outer end flaps by removing some volume from the folded edges of the inner end flaps.

Turning to the construction of the carton as illustrated in FIG. 2, the carton 200 can be formed by a series of sequential folding operations. The folding process is not limited to that described below and may be altered according to particular manufacturing requirements.

Figure 3A:
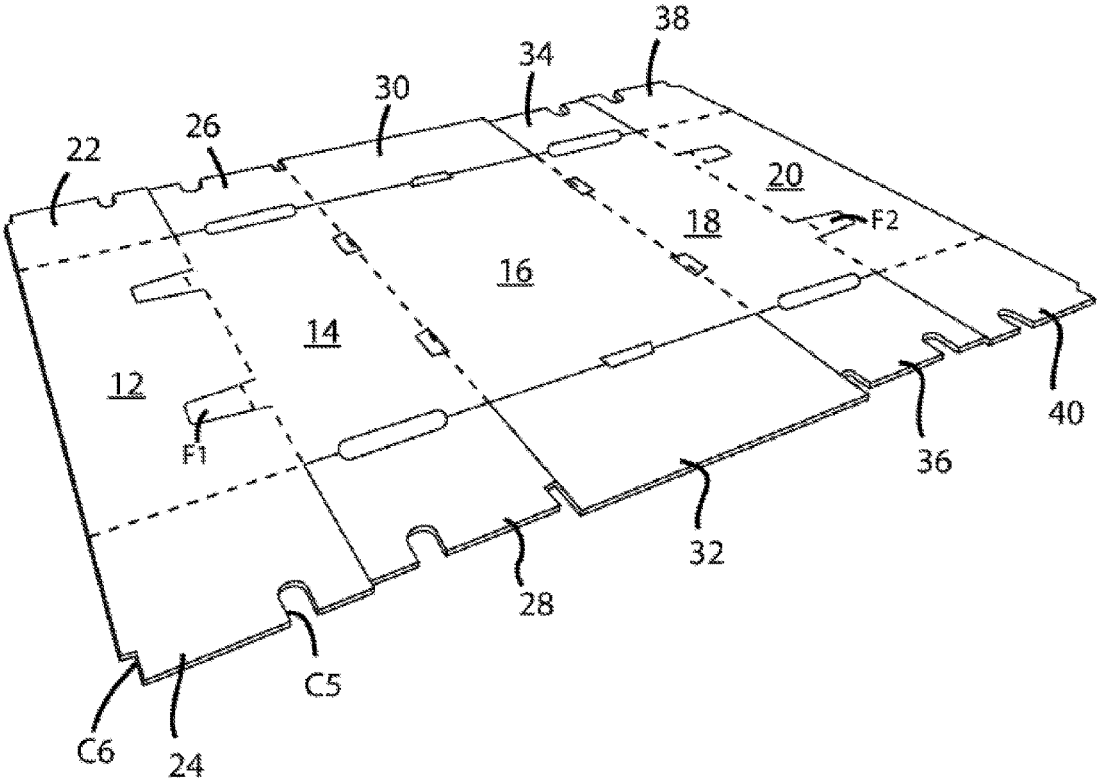
FIG. 3A-3E are perspective views showing various steps in the construction of the carton of FIG. 2.

Blank 10 is positioned with its treated surface facing up as shown in FIG. 3A.

Glue or other adhesive treatment can be applied to the untreated surface of first outer side panel 12 or, alternatively, to the untreated surface of first inner side panel 14. Glue or other adhesive treatment is also applied to the untreated surface of tabs F1 or, alternatively, to a corresponding portion of the untreated surface of first inner side panel 14. Glue or other adhesive treatment is also applied to the untreated surfaces of first and second inner end flaps 26, 28 or, alternatively to the untreated surfaces of first and second outer end flaps 22, 24.

Glue or other adhesive treatment can be applied to the untreated surface of second outer side panel 20 or, alternatively, to the untreated surface of second inner side panel 18. Glue or other adhesive treatment is also applied to the untreated surface of tabs F2 or, alternatively, to a corresponding portion of the untreated surface of second inner side panel 18. Glue or other adhesive treatment is also applied to the untreated surfaces of third and fourth inner end flaps 34, 36 or, alternatively to the untreated surfaces of third and fourth outer end flaps 38, 40.

Figure 3B:
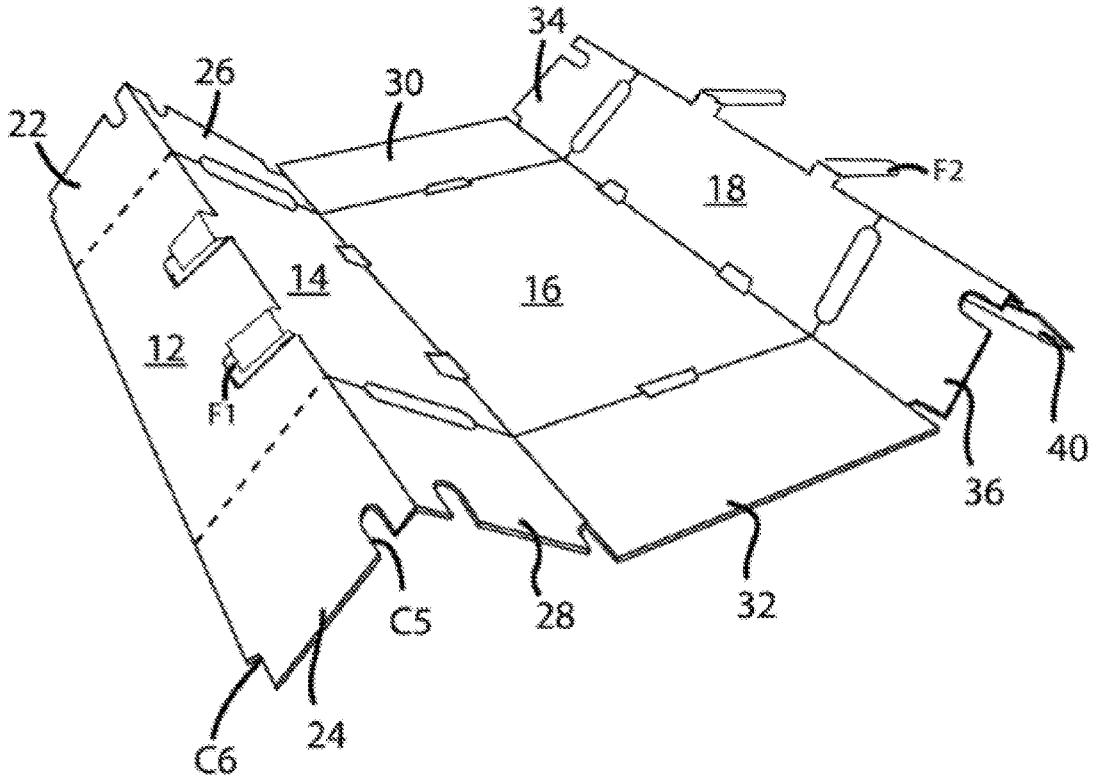

Inner side panels 14, 18 are folded inwardly about respective fold lines 44, 46 while outer side panels 12, 20 are simultaneously folded back about respective fold lines 42, 48. This results in the partially-constructed carton shown in FIG. 3B.

Figure 3C:
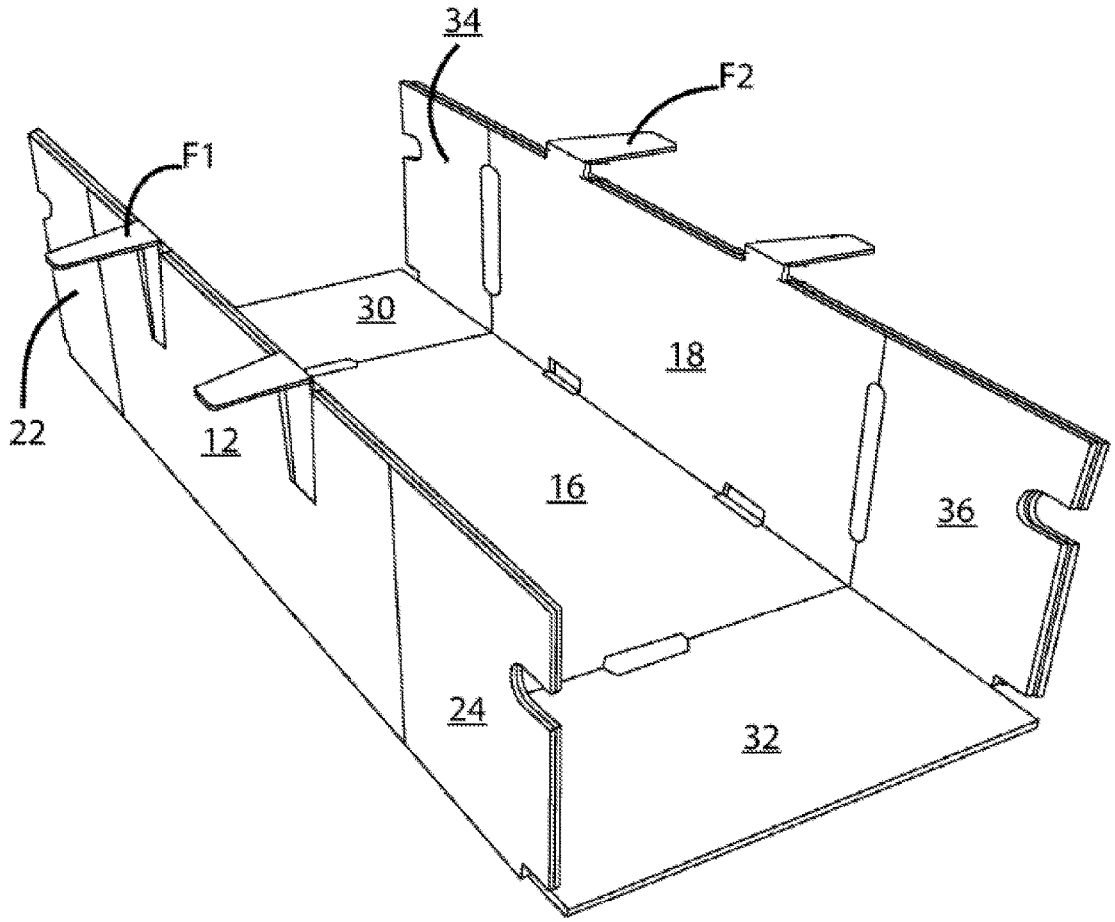

The folding of blank 10 along fold lines 44, 46, 42, 48 is continued until the untreated surfaces of respective inner side panels 14, 18 and outer side panels 12, 20 are brought into face-contacting relationship with one another and secured together to form the carton's side walls. The untreated surfaces of inner end flaps 26, 28, 34, 36 are also brought into face-contacting relationship with the untreated surfaces of respective outer end flaps 22, 24, 38, 40 and secured thereto. The folding machinery (not shown) may include a fixed "hood" positioned on each side of the partially-erected carton over the side panels at the approximate height of the fully constructed side walls. As the side walls are folded into place, the tabs F1, F2 come into contact with the hood, causing them to be folded outwardly along respective fold lines 43*a*, 43*b*, 49*a*, 49*b* until they are in a plane substantially perpendicular to that of the side walls. This results in the partially-constructed shown in FIG. 3C.

Figure 3D:
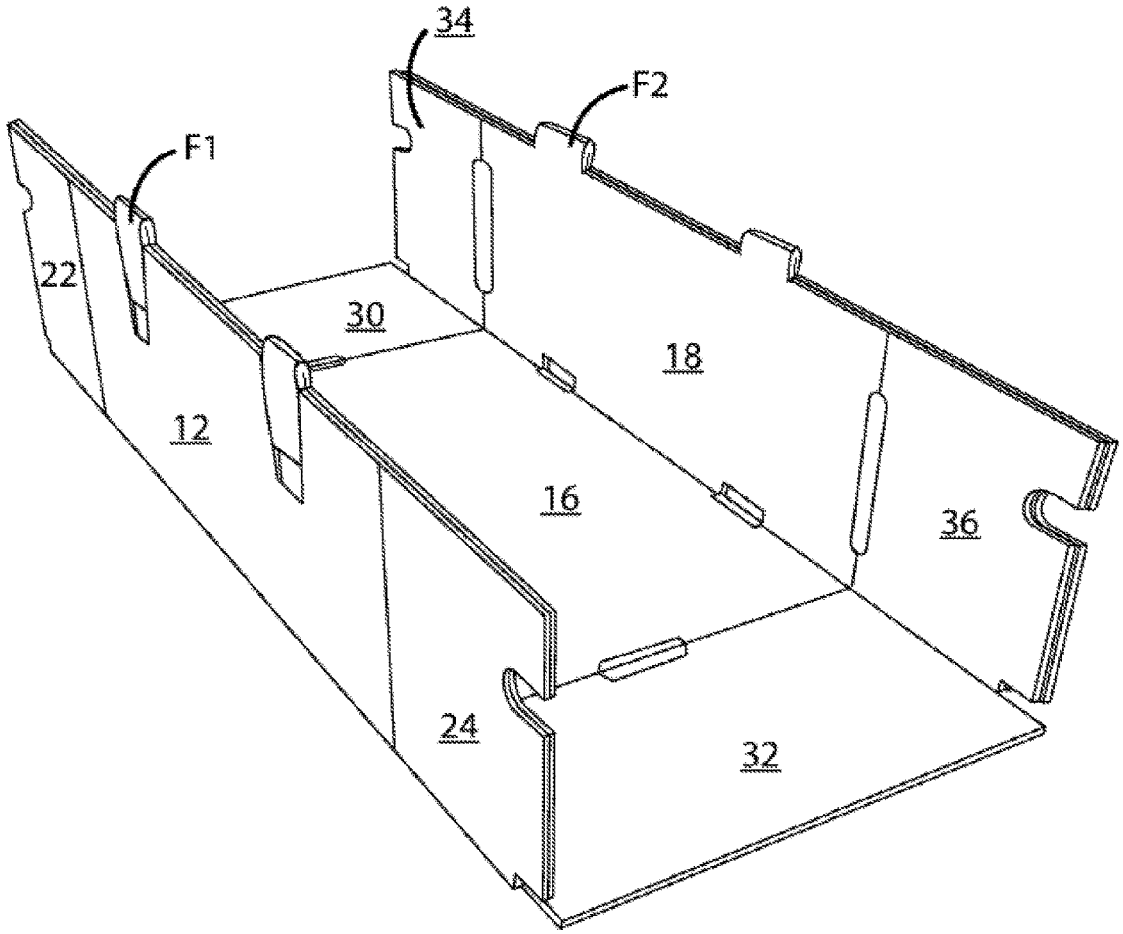

Tabs F1 are then folded back fully about fold lines 43*a*, 43*b* and into apertures in first outer side panel 12 that were defined by the tabs F1. These apertures allow the untreated surfaces of tabs F1 to be brought into face-contacting relationship with an untreated surface of first inner side panel 14. The untreated surfaces of tabs F1 are secured to the untreated surface of first inner side panel 14. Tabs F2 are also folded back fully about fold lines 49*a*, 49*b* and into apertures in second outer side panel 20 that were defined by the tabs F2. These apertures allow the untreated surfaces of tabs F2 to be brought into face-contacting relationship with an untreated surface of second inner side panel 18. The untreated surfaces of tabs F2 are secured to the untreated surface of second inner side panel 18. These steps result in the partially-constructed carton shown in FIG. 3D.

Figure 3E:
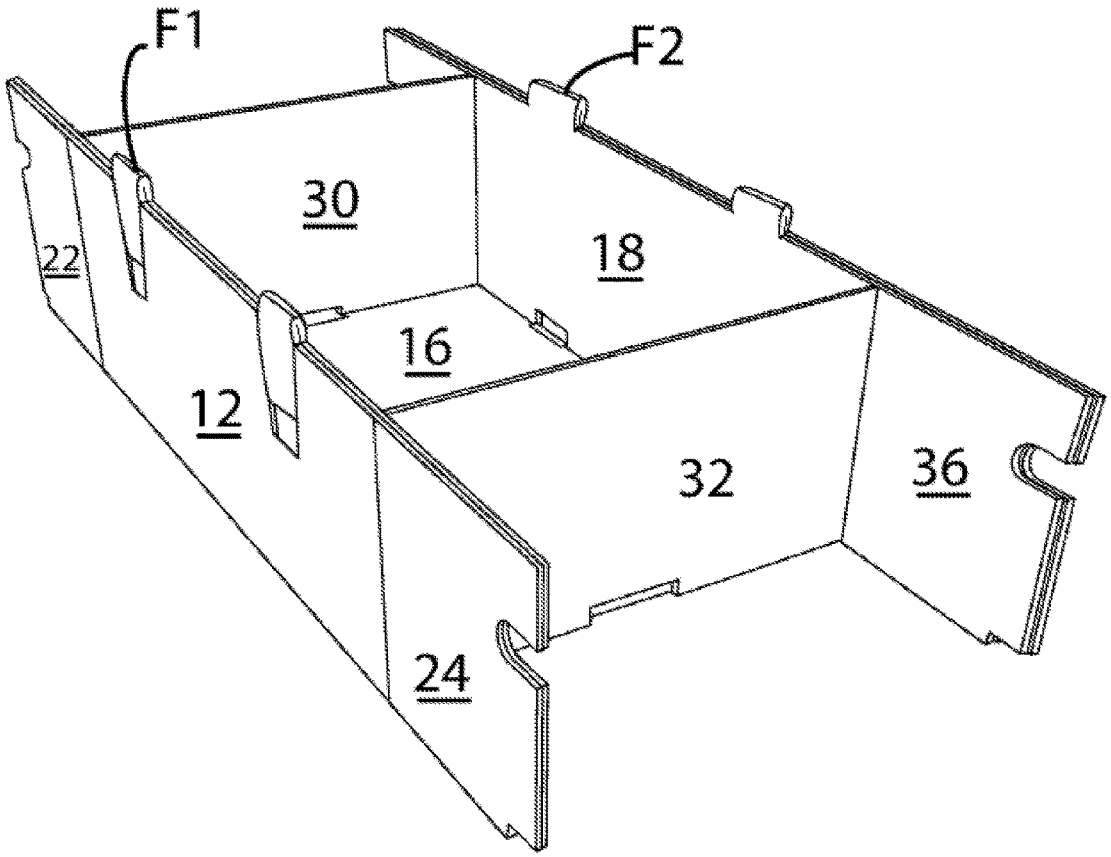
Figure 4A:
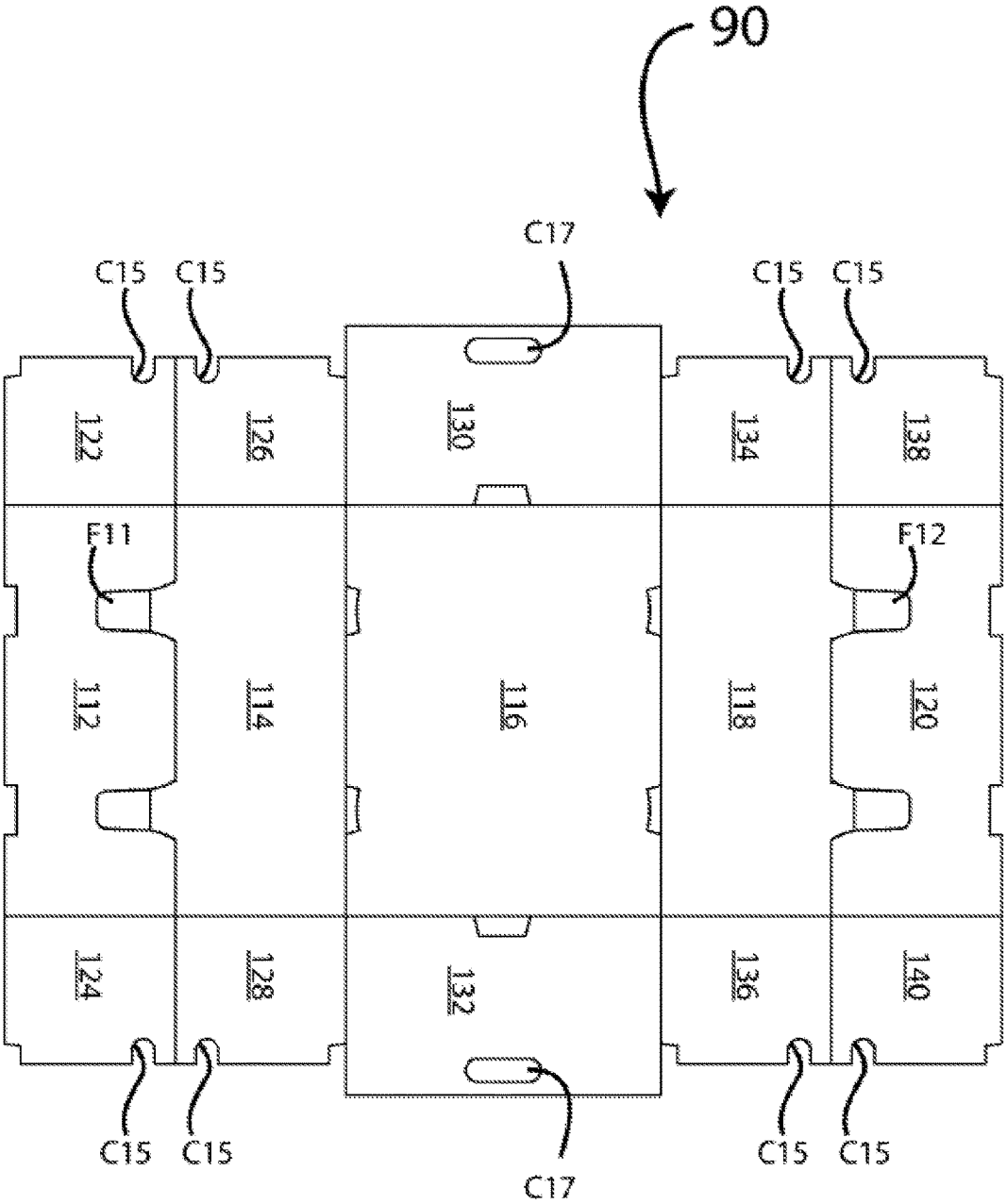
FIG. 4A (prior art)
FIG. 4A is a plan view of a blank for forming a carton according to the prior art.
Figure 4B:
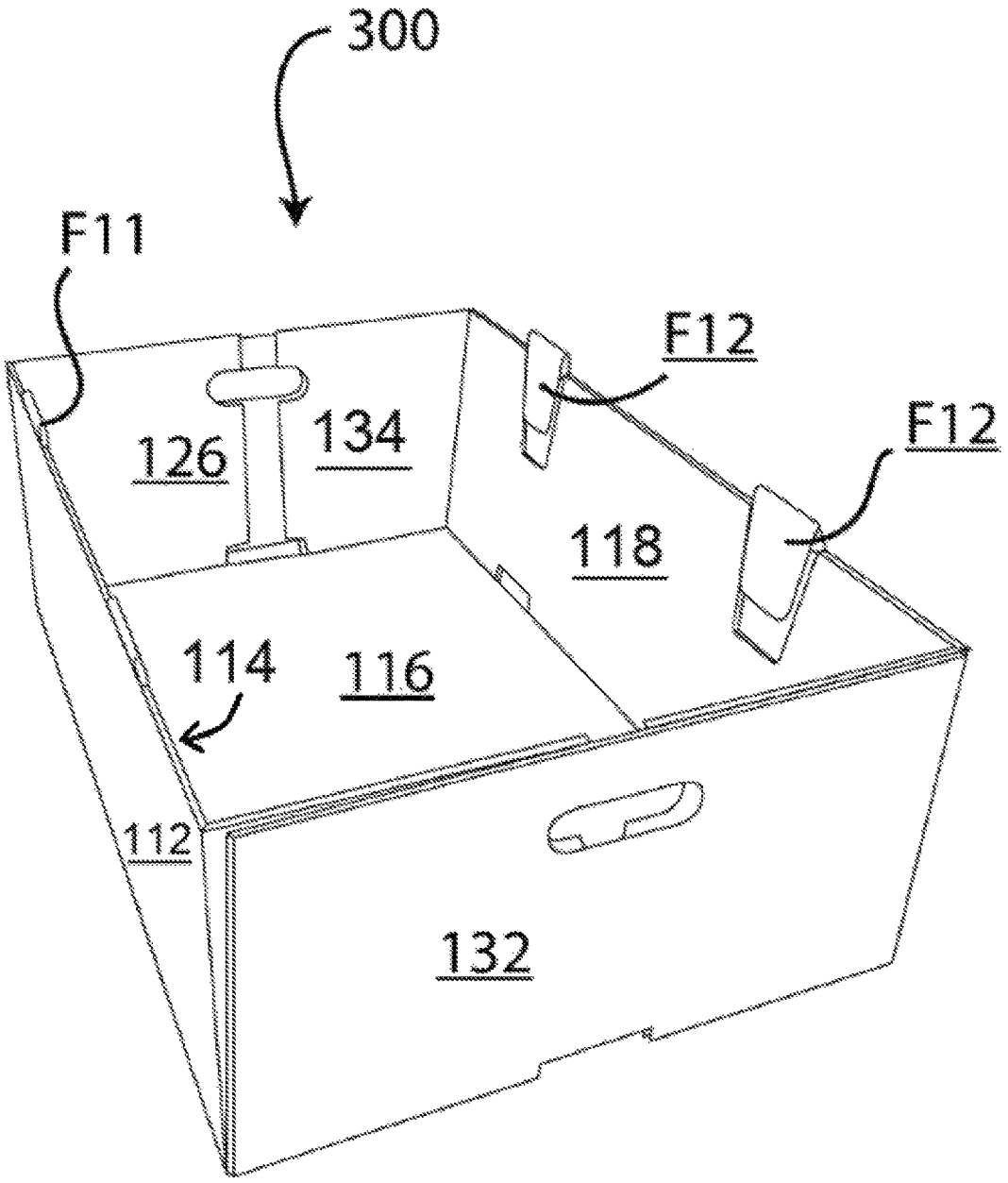
FIG. 4B (prior art)
FIG. 4B is a perspective view of a prior art carton formed from the blank of FIG. 4A.

First end panel 30 is folded inwardly about fold line 54, thereby orienting first end panel 30 in a substantially vertical orientation. Second end panel 32 is folded inwardly about fold line 64, thereby orienting second end panel 32 in a substantially vertical orientation. These steps result in the partially-constructed carton shown in FIG. 3E.

Glue or other adhesive treatment can be applied to the treated surfaces of first, second, third, and fourth inner end flaps 26, 28, 34, 36 or, alternatively to corresponding portions of the untreated surfaces of first and second end panels 30, 32. First, second, third, and fourth inner end flaps 26, 28, 34, 36 (together with first, second, third and fourth outer end flaps 22, 24, 38, 40) are folded inwardly about respective fold lines 52, 62, 56, 66 such that the treated surfaces of first and third inner end flaps 26, 34 are brought into face-contacting relationship with the untreated surface of first end panel 30, and the treated surfaces of second and fourth inner end flaps 28, 36 are brought into face-contacting relationship with the untreated surface of second end panel 32. The treated surfaces of first and third inner end flaps 26, 34 are secured to the untreated surface of first end panel 30. The treated surfaces of second and fourth inner end flaps 28, 36 are secured to the untreated surface of second end panel 32. These steps result in the fully-constructed carton as shown in FIG. 2.

Referring again to FIG. 2, the folded-over tabs F1, F2 project upwards from an upper edge of the carton's side walls forming stacking tabs that are configured to facilitate secure stacking of multiple cartons. The stacking tabs of a first carton are configured to be received within side apertures C1, C2 of a second carton. In addition to facilitating carton stacking, side apertures C1, C2 may also promote carton ventilation and/or drainage. End apertures C3, C4 and overlapping cutouts C6 may also facilitate carton stacking, ventilation, and/or drainage. Overlapping cutouts C5 of first inner and outer end flaps 26, 22 align with overlapping cutouts C5 of third inner and outer end flaps 34, 38 to form a first handle structure H1. Overlapping cutouts C5 of second inner and outer end flaps 28, 24 align with overlapping cutouts C5 of fourth inner and outer end flaps 36, 40 to form a second handle structure H2 (not shown) that may generally mirror handle structure H1. Handle structures H1, H2 are configured to receive a user's fingers to facilitate lifting and carrying of the carton. In the illustrated embodiment, the handle structures H1, H2 do not extend completely through the carton's end walls. Such a configuration may be desirable to prevent a user's fingers from entering into the interior of the carton and bruising sensitive produce or to prevent smaller articles from spilling out through the handles. In other embodiments, however, end panels 30, 32 may include handle cutouts aligned with cutouts C5 so as to create handle structures that extend completely through the carton's end walls.

Advantageously, blank 10 can produce a carton 200 having a treated surface (e.g., printing or water-resistant coating) on all sides with the exception of the lower surface of the base wall (i.e., the surface on which the carton 200 rests) without the need to treat both sides of the blank 10, although in certain embodiments both sides of the blank may be treated. Thus, the interior and exterior surfaces of the side and end walls as well as the interior surface of the base wall are all treated. As another advantage, the interior surfaces of the carton's side and end walls can be substantially smooth and uninterrupted by folded edges, reducing the risk of fruit damage and providing a clean surface for presentation of informational or promotional content.

It can be appreciated that various changes may be made within the scope of the present invention. For example, the size and shape of the panels may be adjusted to create cartons having different sizes and dimensions. As another example, in certain embodiments, both sides (or neither side) of the blank may be treated.

It will be recognized that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and apertures may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the terms "weakened line of severance", "severance line" and "frangible line" each may refer to all manner of lines formed in the blank or substrate of sheet material that facilitate separating portions of the blank or substrate of sheet material from one another, or otherwise that indicate optimal separation locations on the blank or substrate. As used herein, the terms "weakened line of severance", "severance line" and "frangible line" each may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines, weakened lines of severance, frangible lines and severance lines can each includes elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a frangible line. The line of perforations can be designed to facilitate folding and resist breaking to provide a fold line, to facilitate folding and facilitate breaking with more effort to provide a frangible fold line, or to facilitate breaking with little effort to provide a frangible line.

The invention claimed is:

1. A method of forming a carton comprising:

providing a blank having a first surface and a second surface disposed opposite said first surface, said blank comprising a plurality of main panels hinged together in a linear series, said plurality of main panels comprising a bottom panel, first and second inner side panels, and first and second outer side panels, wherein said first outer side panel is hingedly connected to said first inner side panel, said first inner side panel is hingedly connected to said bottom panel, said bottom panel is hingedly connected to said second inner side panel, and said second inner side panel is hingedly connected to said second outer side panel, said blank further comprising first and second end panels, first, second, third, and fourth inner end flaps, and first, second, third, and fourth outer end flaps, wherein said first and second end panels are hingedly connected to said bottom panel at respective opposite ends of said bottom panel, said first and second outer end flaps are hingedly connected to said first outer side panel at respective opposite ends of said first outer side panel, said third and fourth outer end flaps are hingedly connected to said second outer side panel at respective opposite ends of said second outer side panel, said first and second inner end flaps are hingedly connected to said first inner side panel at respective opposite ends of said first inner side panel, and said third and fourth inner end flaps are hingedly connected to said second inner side panel at respective opposite ends of said second inner side panel;

folding said first outer side panel back onto said first inner side panel and securing it thereto in a face-contacting relationship;

folding said second outer side panel back onto said first inner side panel and securing it thereto in a face-contacting relationship;

folding said first outer side panel and said first inner side panel about said bottom panel so as to form a first side wall of said carton;

folding said second outer side panel and said second inner side panel about said bottom panel so as to form a second side wall of said carton, said bottom panel forming a bottom wall of said carton;

folding said first and second end panels about said bottom panel to form respective first and second end walls of said carton;

folding said first and third inner end flaps and said first and third outer end flaps into an overlapping arrangement with an exterior surface of said first end panel and securing them thereto; and folding said second and fourth inner end flaps and said second and fourth outer end flaps into an overlapping arrangement with an exterior surface of said second end panel and securing them thereto; and wherein the interior surface of said bottom wall, and the interior and exterior surfaces of the first and second side walls and first and second end walls are each defined substantially entirely by the first surface.

2. The method of claim 1, wherein said first surface is a treated surface and said second surface is an untreated surface, said treated surface having received one or more surface treatments, said untreated surface not having received said one or more surface treatments.

3. The method of claim 2, wherein said one or more surface treatments comprises printing.

4. The method of claim 2, wherein said one or more surface treatments comprises application of a water resistant coating.

5. The method of claim 1, wherein the interior surfaces of said first and second end walls are each substantially smooth and uninterrupted by folded edges.

6. The method of claim 5, wherein the interior surfaces of said first and second side walls and the interior surface of said bottom wall are each substantially smooth and uninterrupted by folded edges.

7. The method of claim 1, wherein said first and second end walls define respective first and second handle structures.

8. The method of claim 1, wherein said first side wall defines at least one first stacking tab that projects from an upper edge of said first side wall, wherein said second side wall defines at least one second stacking tab that projects from an upper edge of said second side wall.

9. The method of claim 8, wherein said blank defines a plurality of inner end flap apertures, each of the plurality of inner end flap apertures being disposed along a central length of a fold line disposed between one of said first, second, third, or fourth inner end flaps and a respective one of said first or second inner side panels.

10. The method of claim 8, wherein said at least one first stacking tab comprises a first folding tab that projects from an upper edge of the interior surface of said first side wall and is folded back onto the exterior surface of said first side wall, and wherein said at least one second stacking tab comprises a second folding tab that projects from an upper edge of the interior surface of said second side wall and is folded back onto the exterior surface of said second side wall.

11. The method of claim 8, wherein said carton defines at least one first side aperture and at least one second side aperture, said at least one first side aperture being defined in part by both said bottom wall and said first side wall, said at least one second side aperture being defined in part by both said bottom wall and said second side wall, each of said at least one first side aperture and said at least one second aperture being configured to receive a stacking tab of a second carton.

12. The method of claim 11, wherein said first handle structure comprises a first handle aperture disposed on the exterior surface of the first end wall, wherein said first handle aperture does not extend completely through said first end wall, wherein said second handle structure comprises a second handle aperture disposed on the exterior surface of the second end wall, wherein said second handle aperture does not extend completely through the second end wall.

13. The method of claim 8, wherein said carton defines at least one first end aperture and at least one second end aperture, said at least one first end aperture being defined in part by both said bottom wall and said first end wall, said at least one second end aperture being defined in part by both said bottom wall and said second end wall.

* * * * *